US011587723B2

(12) United States Patent
Yoshida et al.

(10) Patent No.: US 11,587,723 B2
(45) Date of Patent: Feb. 21, 2023

(54) REACTOR HAVING RELAY MEMBER WITH INPUT/OUTPUT TERMINAL

(71) Applicant: FANUC CORPORATION, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 708 days.

(21) Appl. No.: 16/596,082

(22) Filed: Oct. 8, 2019

(65) Prior Publication Data

US 2020/0126714 A1 Apr. 23, 2020

(30) Foreign Application Priority Data

Oct. 17, 2018 (JP) ..... JP2018-195686

(51) Int. Cl.
*H01F 27/28* (2006.01)
*H01F 27/29* (2006.01)
*H01F 27/30* (2006.01)

(52) U.S. Cl.
CPC ..... *H01F 27/29* (2013.01); *H01F 27/306* (2013.01)

(58) Field of Classification Search
USPC ..... 336/198, 5, 55
See application file for complete search history.

(56) References Cited

U.S. PATENT DOCUMENTS

2012/0106210 A1* 5/2012 Xu ..... H02M 1/126 336/221
2013/0187741 A1* 7/2013 Goodrich ..... H01F 3/10 336/170
2016/0125998 A1* 5/2016 Bhide ..... H01F 41/0233 336/5
2017/0154718 A1* 6/2017 Maeda ..... H01F 3/14
(Continued)

FOREIGN PATENT DOCUMENTS

JP 201759805 A 3/2017
JP 2017103269 A 6/2017
JP 2018147982 A 9/2018

OTHER PUBLICATIONS

English Abstract and Machine Translation for Japanese Publication No. JP 2017-103269 A, published Jun. 8, 2017, 31 pgs.
(Continued)

*Primary Examiner* — Shawki S Ismail
*Assistant Examiner* — Kazi S Hossain
(74) *Attorney, Agent, or Firm* — Fredrikson & Byron, P.A.

(57) ABSTRACT

A reactor includes: an outer peripheral iron core; three leg iron cores; and three coils, each of the coils having an input side coil end and an output side coil end projecting from a same end surface on an end side in the axial direction of the three leg iron cores, where the three coils include two first coils in which a projecting position of the input side coil end and a projecting position of the output side coil end has a first relative positional relationship and include one second coil having a second relative positional relationship opposite to the first relative positional relationship and where winding directions from the input side coil end to the output side coil end of the first and the second coils are reversed to each other.

4 Claims, 8 Drawing Sheets

(56) References Cited

U.S. PATENT DOCUMENTS

| | | | | |
|---|---|---|---|---|
| 2018/0254135 | A1* | 9/2018 | Tsukada | H01F 27/29 |
| 2019/0035530 | A1* | 1/2019 | Yoshida | H01F 27/26 |

OTHER PUBLICATIONS

English Abstract and Machine Translation for Japanese Publication No. JP 2018-147982 A, published Sep. 20, 2018, 29 pgs.
English Machine Translation for Japanese Publication No. 2017-059805 A, published Mar. 23, 2017, 35 pgs.

* cited by examiner

REACTOR HAVING RELAY MEMBER WITH INPUT/OUTPUT TERMINAL

BACKGROUND OF THE INVENTION

1. Field of the Invention

The present invention relates to a reactor and more particularly to a reactor having a relay member with an input/output terminal.

2. Description of the Related Art

Reactors are provided between a power supply side (primary side) and an inverter; or between a load side (secondary side) such as a motor, etc. and an inverter and are used to reduce inverter failure or to improve power factor in industrial robots and machine tools and the like.

As a reactor that prevents magnetic flux from leaking to the outside, there has been reported a three-phase reactor including a central iron core, an outer peripheral iron core surrounding the central iron core, and at least three connecting portions magnetically connecting the central iron core and the outer peripheral iron core, where the connecting portions include one or more connecting iron cores, one or more coils wound around the connecting iron cores, and one or more gaps (e.g., JP-A-2017-059805).

In the reactor in the related art, coils in which the positions of two terminals in each coil are the same are used for the three coils, and when connecting each of the terminals to a terminal block with a relay member for each of the three coils, there has been a problem that a shape of the relay member becomes complicated. In addition, when the relay members cross each other, there is a risk of shorting due to vibration or the like.

SUMMARY OF THE INVENTION

An object of this invention is to provide a reactor which can prevent a shape of relay members connected to terminals of coils from becoming complex.

A reactor according to the embodiments of the present disclosure includes: an outer peripheral iron core; three leg iron cores provided on an inner surface side of the outer peripheral iron core and spaced apart from each other in a circumferential direction; and three coils wound around each of the three leg iron cores, each of the three coils having an input side coil end and an output side coil end projecting from a same end surface on an end side in the axial direction of the three leg iron cores, where the three coils include two first coils in which a projecting position of the input side coil end and a projecting position of the output side coil end at a portion projecting from the end surface have a first relative positional relationship, and one second coil in which the projecting position of the input side coil end and the projecting position of the output side coil end at the portion projecting from the end surface have a second relative positional relationship opposite to the first relative positional relationship, and a winding direction from the input side coil end to the output side coil end of the first coil and a winding direction from the input side coil end to the output side coil end of the second coil are reversed to each other.

According to a reactor according to the embodiments of the present disclosure, it is possible to prevent a shape of relay members connected to terminals of coils from becoming complicated. Further, since the relay members do not cross each other, the risk of shorting due to vibration or the like can be suppressed.

DETAILED DESCRIPTION

Hereinafter, a reactor according to the present invention will be described with reference to the drawings. However, the technical scope of the present invention is not limited to these embodiments and includes the present invention described in the claims and elements equivalent thereto.

Figure 1A:
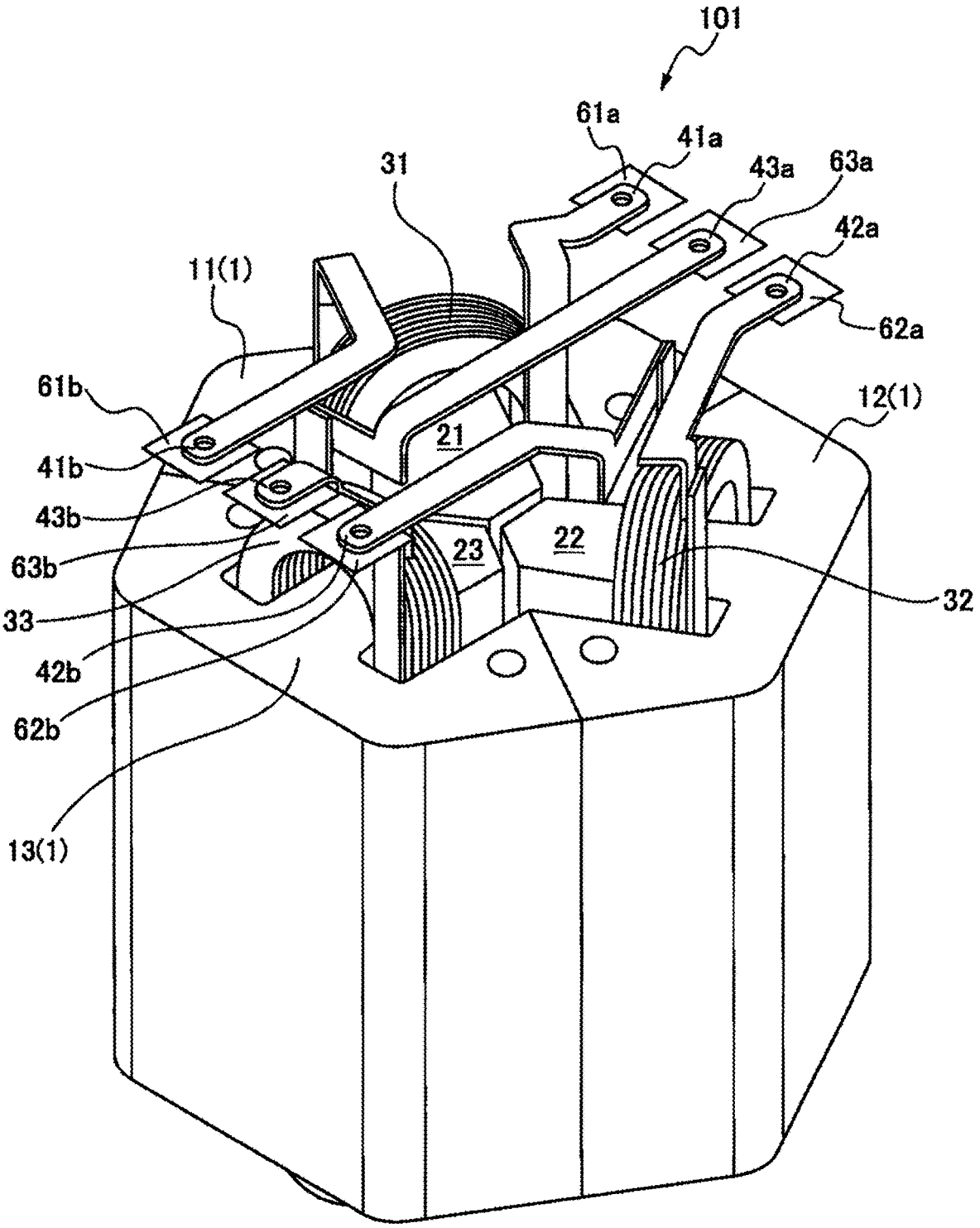
FIG. 1A is a perspective view of a reactor according to Example 1.
Figure 1B:
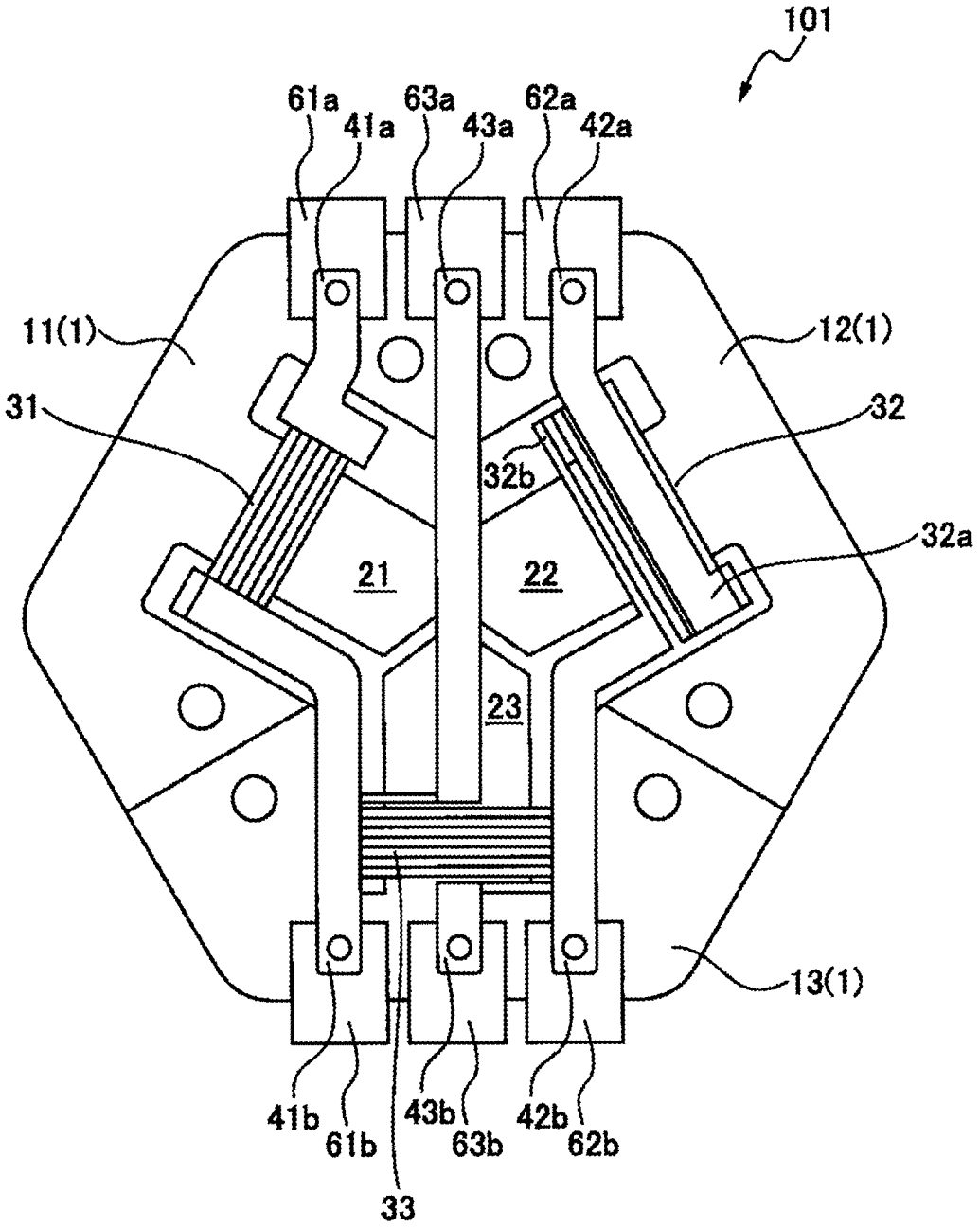
FIG. 1B is a plan view of the reactor according to Example 1.
Figure 2:
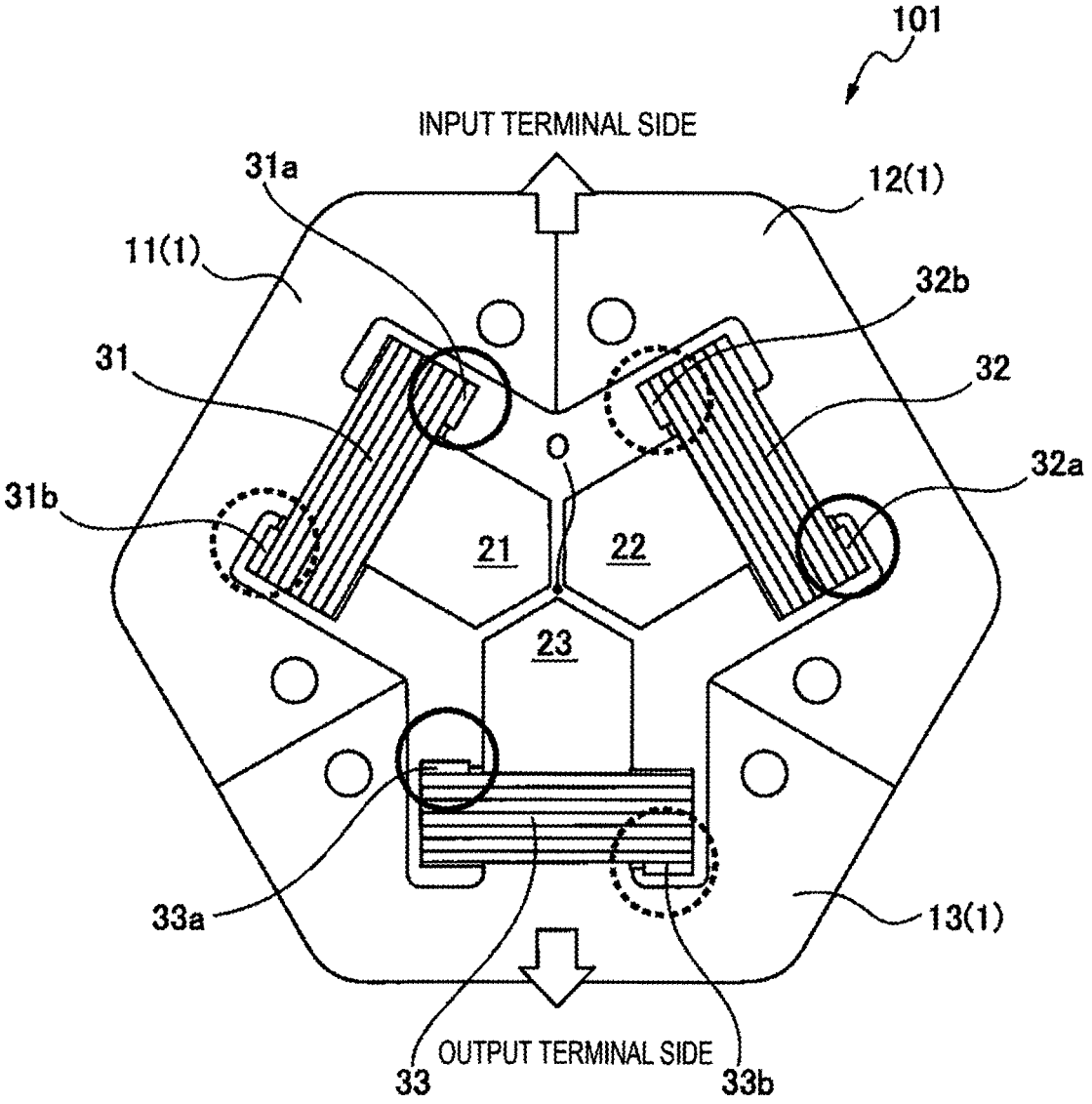
FIG. 2 is a plan view of the reactor according to Example 1, excluding a relay member.

FIG. 1A illustrates a perspective view of a reactor 101 according to Example 1, and FIG. 1B illustrates a plan view of the reactor 101 according to Example 1. FIG. 2 is a plan view of the reactor 101 according to Example 1, excluding relay members. The reactor 101 according to Example 1 includes an outer peripheral iron core 1, three leg iron cores 21, 22, 23, and three coils 31, 32, 33.

The outer peripheral iron core 1 may include three outer peripheral iron core portions 11, 12, 13, that is, the first outer peripheral iron core portion 11, the second outer peripheral iron core portion 12, and the third outer peripheral iron core portion 13. The outer peripheral iron core 1 may have a substantially hexagonal annular structure. However, the outer peripheral iron core 1 may have a circular or other polygon shape.

The three leg iron cores 21, 22, 23 are provided on the inner surface side of the outer peripheral iron core 1 and are arranged spaced apart from each other in a circumferential direction. As illustrated in FIGS. 1A and 1B, the first outer peripheral iron core portion 11 and the first leg iron core 21 may be integrally formed, the second outer peripheral iron core portion 12 and the second leg iron core 22 may be integrally formed, and the third outer peripheral iron core portion 13 and the third leg iron core 23 may be integrally formed.

Three coils 31, 32, 33 are respectively wound around three leg iron cores 21, 22, 23. The three coils 31, 32, 33 each have an input side coil end 31*a*, 32*a*, 33*a* and an output side coil end 31*b*, 32*b*, 33*b*, which project from a same end surface on an end side in the axial direction of the three leg iron cores 21, 22, 23. The three coils 31, 32, 33 include two first coils 31, 33 in which a projecting position of the input side coil end 31*a*, 33*a* and a projecting position of the output side coil end 31*b*, 33*b* at a portion projecting from the end surface have a first relative positional relationship, and one second coil 32 in which a projecting position of the input side coil end 32*a* and a projecting position of the output side coil end 32*b* at a portion projecting from the end surface have a second relative positional relationship opposite to the first relative positional relationship, where a winding direction from the input side coil end to the output side coil end of the first coils 31, 33 and a winding direction from the input side coil end to the output side coil end of the second coil 32 are reversed to each other. The three coils 31, 32, 33 may include flat wire, round wire or litz wire.

As illustrated in FIG. 2, a positional relationship between the input side coil end 31*a*, 33*a* and the output side coil end 31*b*, 33*b* in the two first coils 31, 33 of the three coils, that is, the positional relationship between the input side coil end 31*a* and the output side coil end 31*b* in one first coil 31; and the positional relationship between the input side coil end 33*a* and the output side coil end 33*b* in the other first coil 33 are referred to as a first relative positional relationship. Further, a positional relationship between the input side coil end 32*a* and the output side coil end 32*b* in one second coil 32 of the three coils 31, 32, 33 is referred to as a second relative positional relationship. Here, the second relative positional relationship is opposite to the first relative positional relationship.

Specifically, focusing on a distance from a center O of the outer peripheral iron core 1, the input side terminal 31*a* of the first coil 31 is closer to the center O than the output side terminal 31*b*, but the input side terminal 32*a* of the second coil 32 is farther from the center O than the output side terminal 32*b*. Also, although the first coils 31 and 33 are in rotational symmetry with each other about the center O of the outer peripheral iron core 1, the second coil 32 is not in rotational symmetry with the first coils 31, 33.

Furthermore, three input terminals 61*a*, 62*a*, 63*a* to which the input side coil ends 31*a*, 33*a* of the first coils 31, 33 and the input side coil end 32*a* of the second coil 32 are individually connected; and three output terminals 61*b*, 62*b*, 63*b* to which the output side coil ends 31*b*, 33*b* of the first coils 31, 33 and the output side coil end 32*b* of the second coil 32 are individually connected are further provided, where the three input terminals 61*a*, 62*a*, 63*a* and the three output terminals 61*b*, 62*b*, 63*b* may be arranged to gather on opposite sides to each other on an end side in the axial direction.

Furthermore, it is preferable that first relay members 41*a*, 42*a*, 43*a* connecting the input side coil ends 31*a*, 32*a*, 33*a* to the input terminals 61*a*, 62*a*, 63*a* and second relay members 41*b*, 42*b*, 43*b* connecting the output side coil ends 31*b*, 32*b*, 33*b* to the output terminals 61*b*, 62*b*, 63*b* are further provided.

As illustrated in FIGS. 1A and 1B, by setting, in the two first coils 31, 33 at the portion projecting from the end surface, the projecting position of the input side coil end 31*a*, 33*a* and the projecting position of the output side coil end 31*b*, 33*b* as a first relative positional relationship and by setting, in the one second coil 32 at the portion projecting from the end surface, the projecting position of the input side coil end 32*a* and the projecting position of the output side coil end 32*b* as a second relative positional relationship opposite to the first relative positional relationship, the three first relay members 41*a*, 42*a*, 43*a* and the three second relay members 41*b*, 42*b*, 43*b* can be arranged so that they do not intersect one another.

Figure 3A:
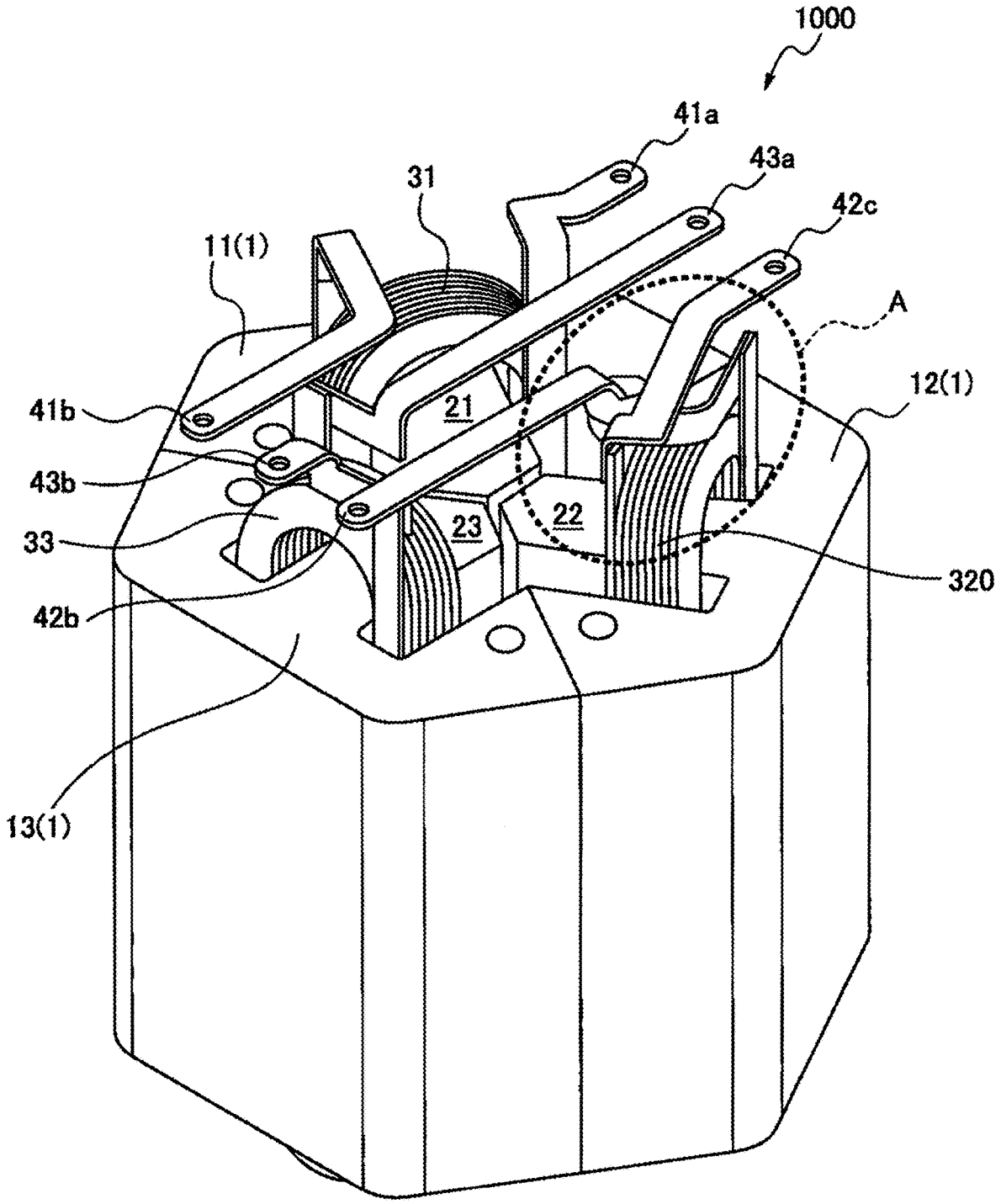
FIG. 3A is a perspective view of a reactor having a relay member of a complicated shape.
Figure 3B:
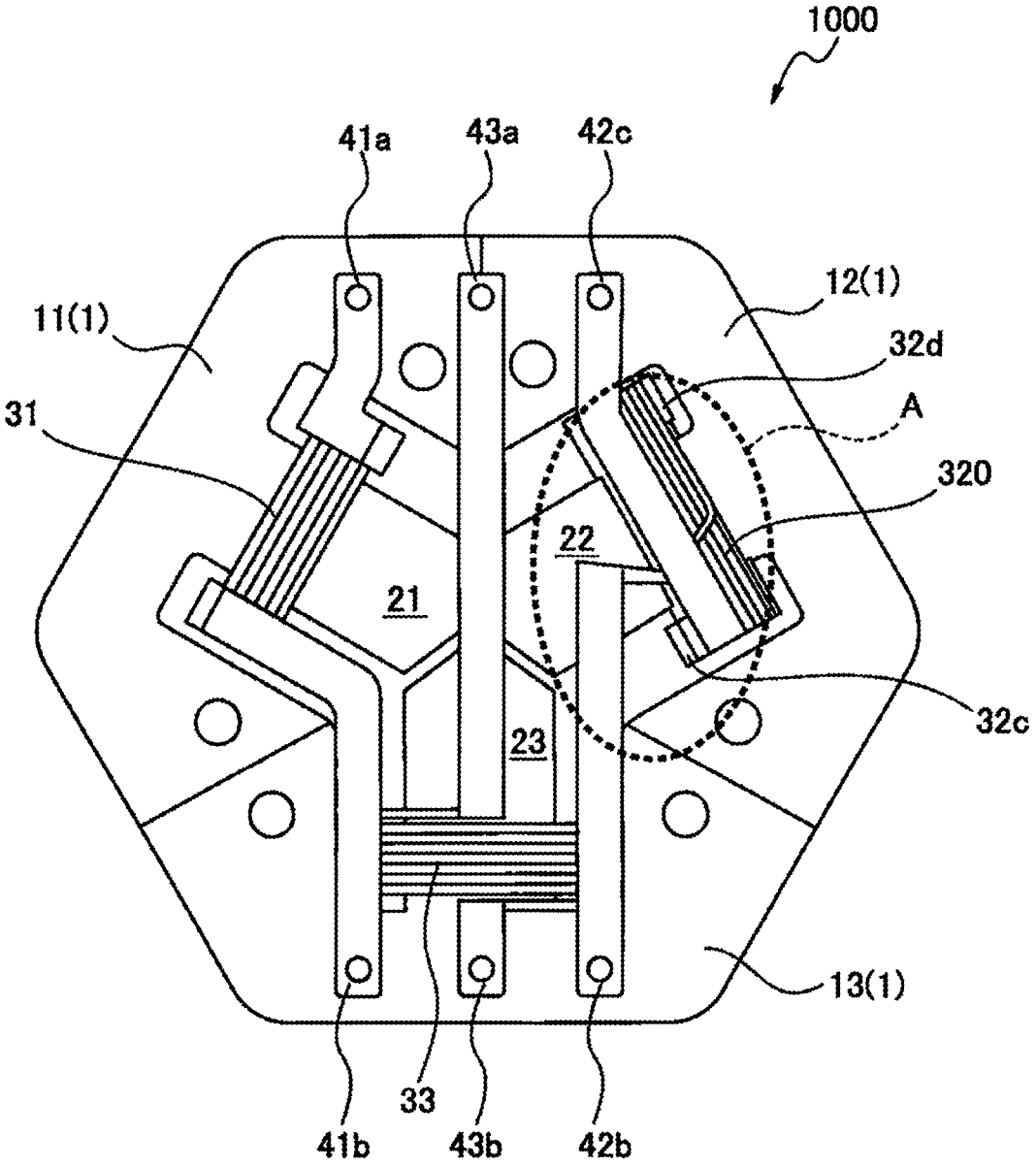
FIG. 3B is a plan view of the reactor having the relay member of the complicated shape.
Figure 4:
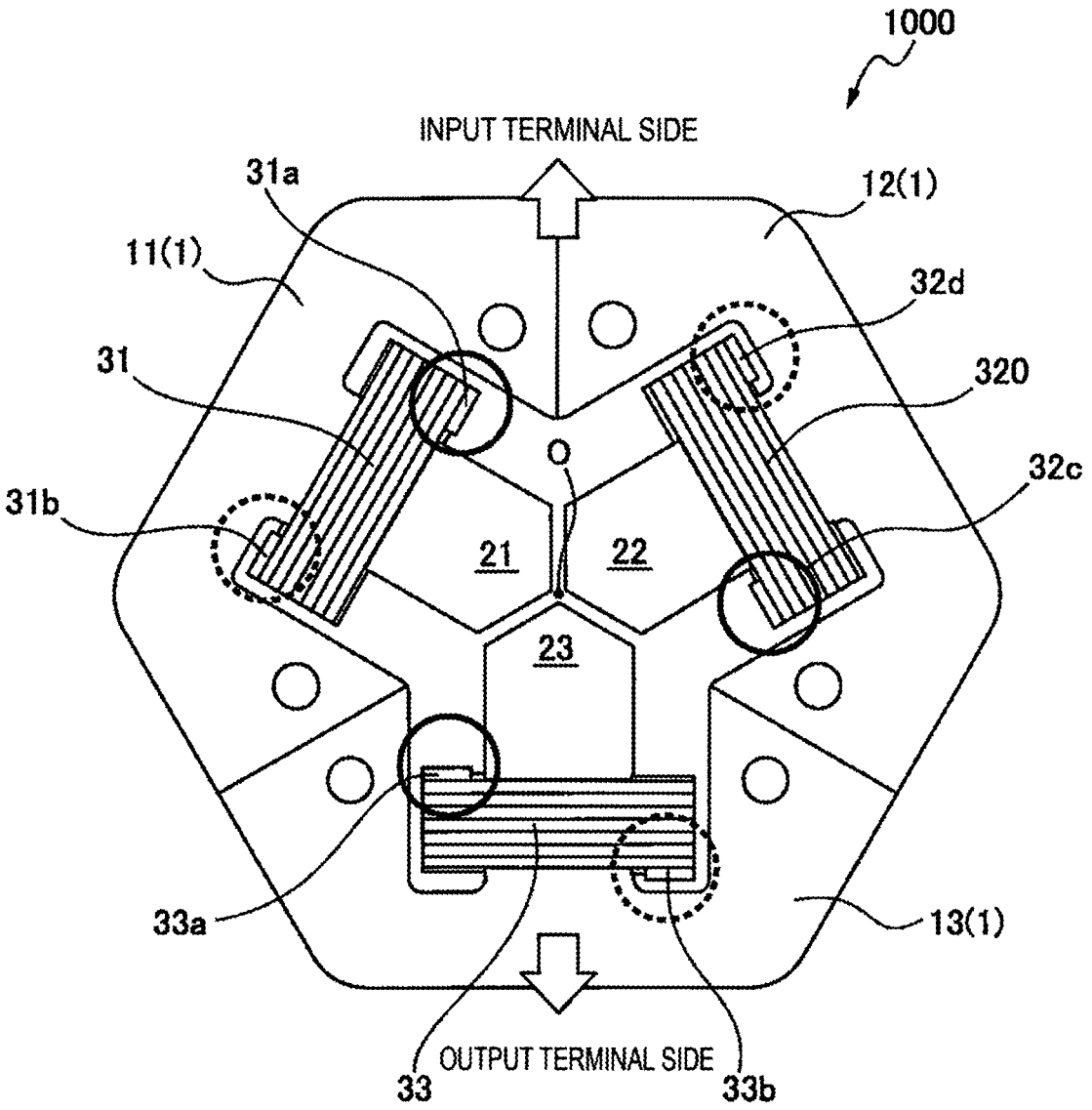
FIG. 4 is a plan view of the reactor in which the shape of the relay member is complicated, excluding the relay member.

Then, a reactor having a relay member of a complicated shape in which the first relay member and the second relay member overlap will be described. FIG. 3A illustrates a perspective view of a reactor 1000 having relay members of a complicated shape, and FIG. 3B illustrates a plan view of the reactor 1000 having the relay members of the complicated shape. FIG. 4 is a plan view of the reactor 1000 in which the shape of the relay members is complicated, excluding the relay members. A first relay member 42*c* and a second relay member 42*d* overlap in a portion surrounded by a dotted line A in FIGS. 3A and 3B. The reason why the first relay member and the second relay member overlap is that the relative positional relationship between the input side coil end 31*a*, 32*c*, 33*a* and the output side coil end 31*b*, 32*d*, 33*b* in the coils 31, 320, 33 is the same in all the three coils 31, 320, 33.

As illustrated in FIG. 3B, the first relay member 42*c* connected to the input side coil end 32*c* of the coil 320 overlaps the second relay member 42*d* connected to the output side coil end 32*d* of the coil 320. On the other hand, in the reactor 101 according to Example 1, as illustrated in FIG. 1B, the first relay member 42*a* connected to the input side coil end 32*a* of the second coil 32 is arranged so as not to overlap the second relay member 42*b* connected to the output side coil end 32*b* of the second coil 32.

Figure 5A:
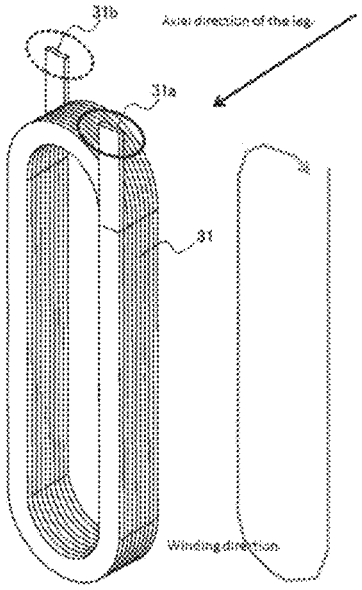
FIG. 5A is a perspective view of a coil in which coil ends have a first relative positional relationship.
Figure 5B:
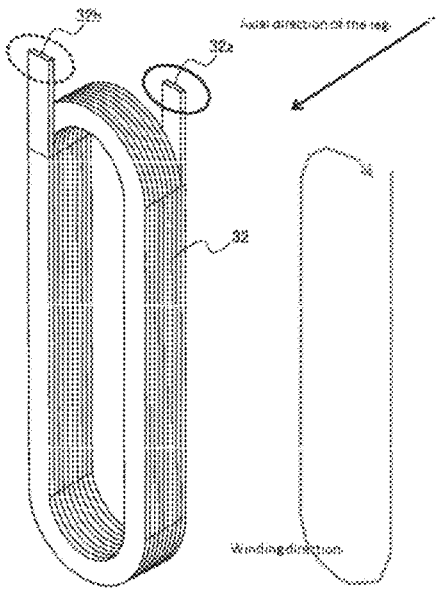
FIG. 5B is a perspective view of a coil in which coil ends have a second relative positional relationship.

In this regard, the positions of the input side coil end and the output side coil end in the coil where the coil ends have the first relative positional relationship and in the coil where the coil ends have the second relative positional relationship will be described. FIG. 5A illustrates a perspective view of the first coil 31 which is a coil having a first relative positional relationship between the coil ends. FIG. 5B illustrates a perspective view of the second coil 32 which is a coil having a second relative positional relationship between the coil ends. As can be seen from FIGS. 5A and 5B, in the reactor 101 according to Example 1, the first relative positional relationship between the projecting position of the input side coil end 31*a* and the projecting position of the output side coil end 31*b* at the portion projecting from the end surface of the first coil 31; and the second relative positional relationship between the projecting position of the input side coil end and the projecting position of the output side coil end at the portion projecting from the end surface of the second coil 32 are opposite to each other. Furthermore, the winding direction from the input side coil end 31*a* to the output side coil end 31*b* of the first coil 31; and the winding direction from the input side coil end 32*a* to the output side coil end 32*b* of the second coil 32 are reversed to each other. In this regard, when the coil ends 31*a* and 32*a* are used as input terminals and the coil ends 31*b* and 32*b* are used as output terminals, the current flow in the first coil 31 and the current flow in the second coil 32 are in the same direction so that the direction of the magnetic field generated by the second coil 32 is the same as the direction of the magnetic field generated by the first coil 31.

By the reactor according to Example 1, the three first relay members and the three second relay members can be arranged so as not to cross each other so that the first relay member and the second relay member may not short out by vibration or the like.

Figure 6:
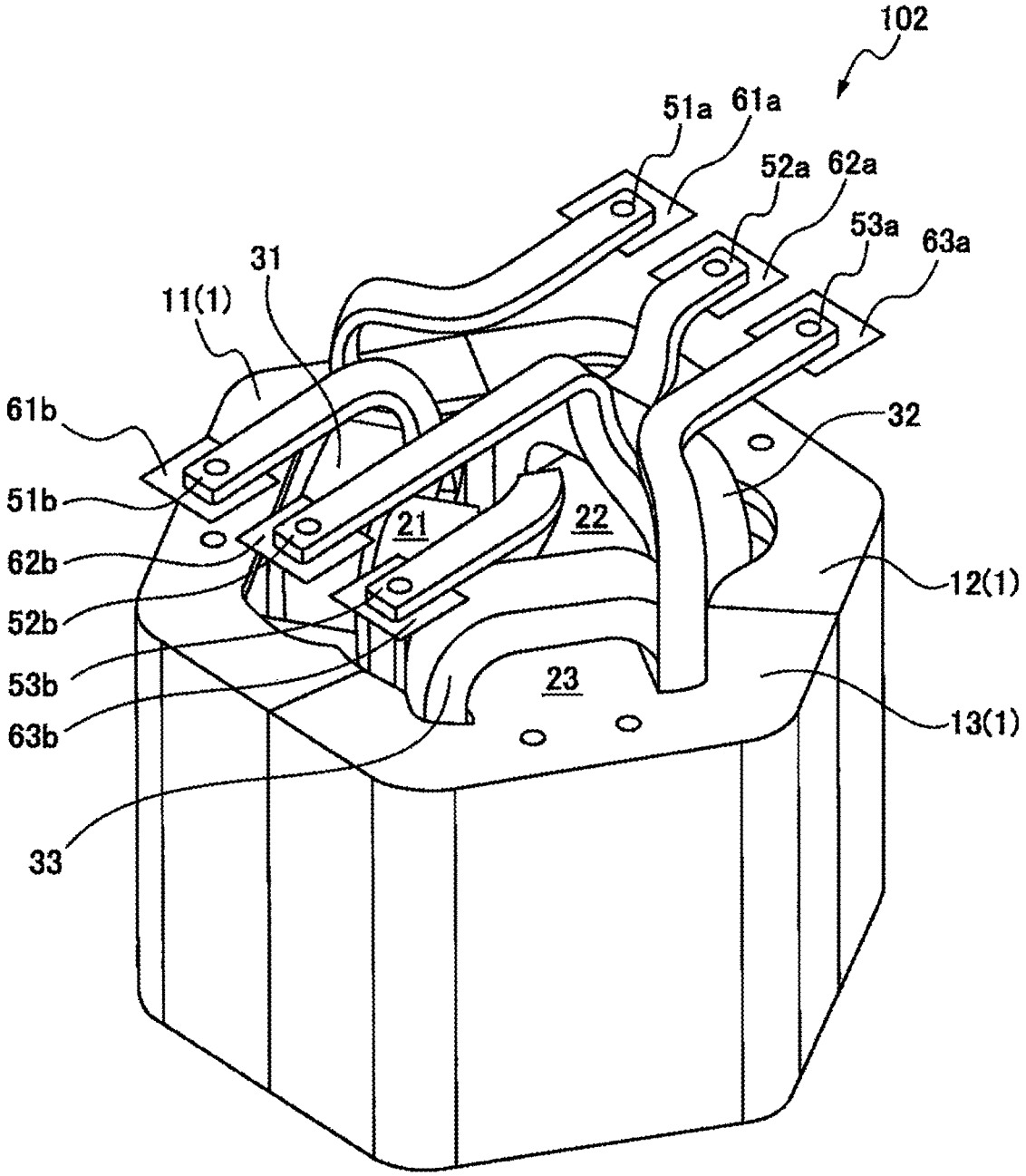
FIG. 6 is a perspective view of a reactor according to Example 2.

Then, a reactor according to Example 2 will be described. FIG. 6 illustrates a perspective view of a reactor 102 according to Example 2. The difference between the reactor 102 according to Example 2 and the reactor 101 according to Example 1 is that the input side coil end 51*a*, 52*a*, 53*a* is directly connected to the input terminal 61*a*, 62*a*, 63*a*, and the output side coil end 51*b*, 52*b*, 53*b* is directly connected to the output terminal 61*b*, 62*b*, 63*b*. The other configuration of the reactor 102 according to Example 2 is the same as that of the reactor 101 according to Example 1, and thus the detailed description thereof will be omitted.

As illustrated in FIG. 6, in one first coil e.g., 31 of the three coils 31, 32, 33, the projecting position of the input side coil end and the projecting position of the output side coil end have a first relative positional relationship, and in the other two second coils 32, 33 of the three coils, the projecting position of the input side coil end and the projecting position of the output side coil end have a second relative positional relationship opposite to the first relative positional relationship.

The three coils 31, 32, 33 may include flat wire, round wire or litz wire.

According to the reactor according to Example 2, since the input side coil end is directly connected to the input terminal and the output side coil end is directly connected to the output terminal, the process of connecting the first relay member and the second relay member to the input side coil end and the output side coil end respectively can be omitted.

Although the example in which the coils 31 and 33 are used as the first coils and the coil 32 is used as the second coil has been described in the description of above Example 1, the present invention is not limited to such an example, but the coil 31 or coil 33 may be used as the second coil. In addition, even if the input side coil end and the output side coil end are interchanged, the reactors according to Examples of the present disclosure can be realized similarly.

The invention claimed is:

1. A reactor comprising:

an outer peripheral iron core;

three leg iron cores provided on an inner surface side of the outer peripheral iron core and spaced apart from each other in a circumferential direction; and three coils wound around each of the three leg iron cores, each of the three coils having an input side coil end and an output side coil end projecting from a same end surface on an end side in an axial direction of the three leg iron cores;

the three coils including two first coils in which a projecting position of the input side coil end and a projecting position of the output side coil end at a portion projecting from the end surface have a first relative positional relationship, and one second coil in which the projecting position of the input side coil end and the projecting position of the output side coil end at the portion projecting from the end surface have a second relative positional relationship opposite to the first relative positional relationship; and a winding direction from the input side coil end to the output side coil end of the first coil and a winding direction from the input side coil end to the output side coil end of the second coil being reversed to each other.

2. The reactor of claim 1, further comprising;

three input terminals to which the input side coil ends of the first coils and the input side coil end of the second coil are individually connected; and three output terminals to which the output side coil ends of the first coils and the output side coil end of the second coil are individually connected, wherein the three input terminals and the three output terminals are arranged to gather on opposite sides to each other on the end side in the axial direction.

3. The reactor of claim 2, further comprising:

first relay members, each of the first relay members connecting respective one of the input side coil ends to respective one of the input terminals; and second relay members, each of the second relay members connecting respective one of the output side coil ends to respective one of the output terminals.

4. The reactor of claim 2, wherein each of the input side coils end is directly connected to respective one of the input terminals, and each of the output side coils end is directly connected to respective one of the output terminals.

* * * * *